US005743063A

United States Patent [19]

Boozer

[11] Patent Number: 5,743,063

[45] Date of Patent: Apr. 28, 1998

[54] SYSTEM FOR MOUNTING BUILDING PANELS ALLOWING BI-AXIAL FREEDOM OF MOVEMENT

[75] Inventor: David W. Boozer, Douglasville, Ga.

[73] Assignee: Non Compact, Inc., Lumberton, N.C.

[21] Appl. No.: 641,973

[22] Filed: May 2, 1996

Related U.S. Application Data

[63] Continuation-in-part of Ser. No. 302,632, Sep. 8, 1994, abandoned.

[51] Int. Cl.[6] ..... E04B 7/16; E04D 3/36

[52] U.S. Cl. ..... 52/713; 52/508; 52/512; 52/551; 52/573.1; 52/749.12; 52/745.05

[58] Field of Search ..... 52/508, 512, 521, 52/537, 550, 551, 506.05, 506.06, 408, 409, 410, 478, 573.1, 712, 713, 749.12, 745.05; 248/298.1

[56] References Cited

U.S. PATENT DOCUMENTS

| | | | |
|---|---|---|---|
| 3,332,186 | 7/1967 | Cammaert | 52/551 X |
| 3,667,182 | 6/1972 | Stemler | 52/497 |
| 3,998,019 | 12/1976 | Reinwall, Jr. | 52/478 |
| 4,213,282 | 7/1980 | Heckelsberg | 52/410 X |
| 4,514,952 | 5/1985 | Johansson | 52/713 |
| 4,522,005 | 6/1985 | Seaburg et al. | 52/713 X |
| 4,575,983 | 3/1986 | Lott, Jr. et al. | 52/713 X |
| 4,651,493 | 3/1987 | Carey | 52/409 X |
| 4,691,491 | 9/1987 | Lilley | 52/712 X |
| 4,796,403 | 1/1989 | Fulton et al. | 52/713 |
| 5,002,882 | 3/1991 | Watkins et al. | 52/478 X |
| 5,127,205 | 7/1992 | Eidson | 52/478 X |
| 5,557,903 | 9/1996 | Haddock | 52/508 |
| 5,600,971 | 2/1997 | Suk | 52/713 |

FOREIGN PATENT DOCUMENTS

| | | | |
|---|---|---|---|
| 2039266 | 2/1972 | Germany | 52/713 |
| 2939-613 | 2/1981 | Germany . | |
| 3-166452 | 7/1991 | Japan | 52/573.1 |

*Primary Examiner*—Wynn E. Wood
*Assistant Examiner*—Laura A. Callo
*Attorney, Agent, or Firm*—Olive & Olive, P.A.

[57] ABSTRACT

The invention provides a number of embodiments of slidable brackets adapted for mounting building panels, especially roof members mounted to structural members in a manner to permit limited uni-axial or bi-axial movement. A preferred embodiment has a channel shaped base member and a channel shaped slider member. The base member is adapted to be secured to an existing roof or to a building frame component. The slider member is formed to slidingly straddle and slide on the base member. For uni-axial motion, the slider member has a single pair of longitudinal slots formed in each of its sides through which a bolt or the like passes and which also passes through a mating bolt hole in the side of the base member. For bi-axial motion, a pair of slots is formed in an attached beam whose axis extends in a direction perpendicular to the axis of the longitudinal slots in the slider member.

7 Claims, 12 Drawing Sheets

SYSTEM FOR MOUNTING BUILDING PANELS ALLOWING BI-AXIAL FREEDOM OF MOVEMENT

CONTINUING APPLICATION INFORMATION

This is a continuation-in-part of co-pending application Ser. No. 08/302,632, filed Sep. 8, 1994, now abandoned.

FIELD OF THE INVENTION

This invention relates to building components, and more particularly to components for the mounting of a building panel and supporting structural beam in a manner to permit in one embodiment unidirectional and in another embodiment, bi-axial movement thereof.

BACKGROUND OF THE INVENTION

All materials, so far as is known, change in size as a result of a change in temperature. Substantially all solids expand when heated and contract when cooled. The extent of the change in dimension which occurs is proportional to the amount of change in temperature. Metals tend to expand and contract to a greater extent in relation to a change in temperature than other types of materials.

Many contemporary industrial and commercial buildings are constructed of preformed metal panels which are attached to a metal framework. Insulation used in such a building is normally intended to keep heat within or without the building, but is not intended to keep the building outer panels dimensions from changing with outside temperature variation. When exposed in certain climates, roofing panels, particularly metal panels, can vary in temperature from a low of minus 20° F. (minus 27° C.) in winter at night to a high of plus 150° F. (plus 66° C.) in summer during the day. This degree of temperature change can cause a typical steel roofing panel to expand lengthwise as much as 1.4 inches per 100 feet (3.5 cm per 30.49 m) in length. Whereas the panels in an assembled roof on some buildings are as much as 500 feet (152 m) in length, this degree of expansion translates to an overall increase in length of 7.0 inches (17.4 cm).

Although expansion is discussed in linear terms, as it was above, expansion occurs volumetrically. That is, the expansion which occurs is in the length, width and thickness of any part. Panels, per so, are very thin, thus the thickness expansion will essentially always be small enough to be ignored. However, the illustrative building of 500 feet in length could be, e.g., 400 feet (122 m) wide and expand widthwise under similar conditions about 5.6 inches (14.2 cm). Thus expansion in the two dimensions which fall in the general plane of a roof panel is significant.

As stated, metal expands to a greater extent than other types of material. It is also commonly known that for practical reasons corrugated sheet metal roof panels are a standard roofing material for large commercial buildings. Since the corrugated panel has little rigidity in the direction perpendicular to the corrugations, a supporting beam, usually a "zee" purlin, is used in a structural framework. In various applications, other shaped beams are used to provide rigidity for a sheet metal roof panel. Two other commonly used support beams are a "C" purlin, shaped in cross section like a letter "C" and a "hat section", shaped in cross section with two inwardly angled panels connected at their top edges by a horizontal panel and each having a horizontally extending lower panel.

When a building is constructed, the roof panels are connected to the metal skeleton beneath, or, perhaps, to concrete block walls. In either case the effect is similar; roof panels receiving exposure to the sun's heat expand and contract in response to the heating and cooling, respectively. The supporting structure expands and contracts less because it is shielded from direct exposure to the sun. Generally, concrete material expands less than metal. As a result, either the supporting structure flexes (if metal) or cracks (if concrete) or, if the support is sufficiently strong, damage is caused to a roof panel around the holes through which fasteners are attached to hold the roof panel to the support base. This damage may take the form of enlarged holes which result in leakage or stress cracking and possible separation. Subsequent repair work can be costly.

Prior attempts to allow building components to move relative to one another are recorded in prior patent art. One such U.S. Pat. No. 4,932,173 to Commins for a Truss Clip, teaches a slotted clip rigidly connected to a supporting beam so that a rafter or other supported member can move in a direction parallel to the slots provided. Another U.S. Pat. No. 5,127,205 to Eidson for a Support Clip For Roofing Panels And Associated Systems teaches a standing slide member which is attached directly to a roofing panel at a corrugation and which slides upon a base which is mounted on a supporting structure. As shown, the clip of the Eidson patent is installed at every roof panel corrugation. A third patent is U.S. Pat. No. 4,796,403 to Fulton et al. for an Articulating Roofing Panel Clip. Fulton discloses a clip which is adapted to attach to a standing seam roof panel to accommodate both rotational and translational movement therebetween. None of the prior art is seen to disclose the features and function of the invention described below.

The problem discussed above is applicable to all large roofs. There are many situations in which a roof constructed according to known methods on an existing building has sustained damage due to thermal or other conditions over the life of the building. Often, it is most practical to erect a new roof over a damaged existing roof. Removing an old damaged roof is a time consuming and expensive operation. Once the old roof has been removed, the interior of the building is exposed to weather during the change. The removal process interferes with any work which could otherwise take place and causes a further layer of insulation to be lost in the process. However, it is also desirable to construct the new roof at a height above the existing roof, without contact therebetween both for beneficial ventilation and enhanced thermal insulation. Thus, a framework to support the new roof at a height, and possibly at a differing angle, above the old roof is a further consideration for which the invention disclosed herein provides a solution.

It is therefore an object of this invention to provide a support bracket for use in a building structure which permits changes in relative position between building components due to thermal expansion and contraction.

It is a further object of this invention to provide a support bracket which permits bi-axial relative movement of the building components.

It is an additional object of this invention to provide a support bracket which is adaptable to new roof or replacement roof construction.

It is a still further object of this invention to provide a support bracket which may be installed at comparatively large intervals in the system employed.

Other objects and advantages will be more fully apparent from the following disclosure and appended claims.

SUMMARY OF THE INVENTION

The present invention provides a support bracket as manifested in a number of embodiments which emanate from a basic method directed to the secure attachment of a building panel and supporting structural beams, particularly as relating to a roofing panel, while permitting expansion and contraction thereof. Exterior wall panels may also benefit from the advantages of the present invention. The underlying method of the invention involves providing a device which is mounted to a support base onto which a building panel and supporting structural beams are mounted so as to permit the building panel to move to a limited degree in relation to the support base.

The primary device provided by the invention comprises a bearing bracket configured with a first component slideable in relation to a second component along a straight line. One of the components of the bracket is fixedly mounted on an existing support structure of a building. A building panel supporting framing member is fixedly mounted on the slideable component of the bracket and a building panel is attached to the framing member. The bracket of the invention thus permits uniaxial movement of the building panel in relation to the supporting structure.

A further embodiment of the invention is formed by fixedly mounting a first bracket upon a second bracket of the invention in perpendicular relation. In this configuration, when the first bracket is fixedly attached to a supporting structure, a building panel framing member attached to the second bracket and supporting a building panel is free to move bi-axially. Additional features and embodiments are disclosed below.

DETAILED DESCRIPTION OF THE INVENTION

Figure 1:
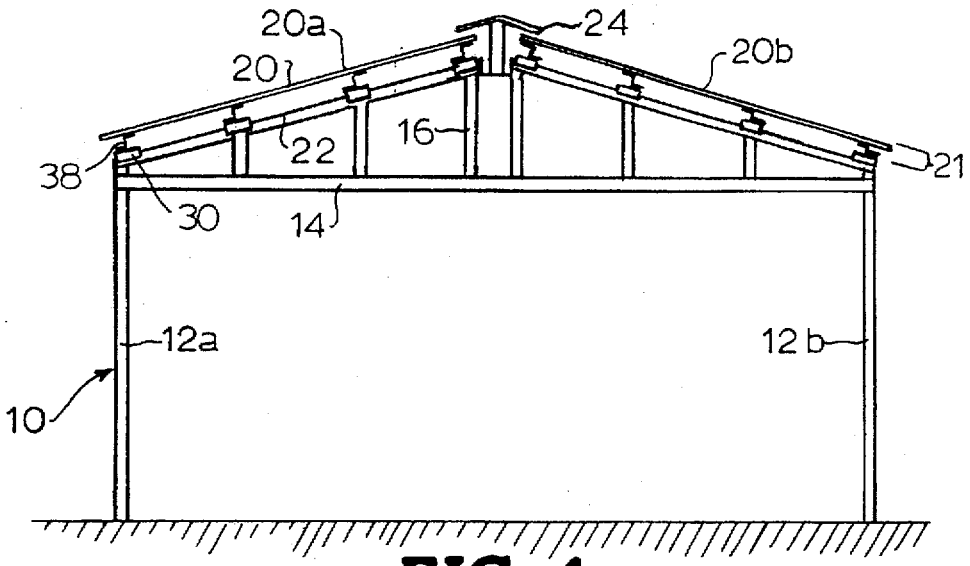
FIG. 1 is an end elevation schematic view of a building having roof panels including a number of bearing brackets of a first embodiment of the invention shown supporting the framing members and roof panels.

As discussed above, expansion and contraction of building panels exposed to environmental temperature fluctuations can be severe enough to cause damage to and failure of those building panels, particularly in the case of roofing panels. FIG. 1 shows an elevation view of a typical building 10 including roof panels 20, as are known in the art, mounted on a quantity of bi-axial floating bearing brackets 30 according to the invention. The building's structural base 12*a*, 12*b* may comprise steel columns or concrete walls, on which is mounted an existing flat roof 14. A series of support columns 16 are affixed to the top of existing flat roof 14 so as to create a roof pitch on which to assemble a rafter 22. While flat roof surfaces were common on commercial and industrial buildings in the past, the problems due to leakage and repair have motivated many building owners to install a pitched roof when a replacement is needed. Floating bearing brackets 30 of the invention are installed on rafters 22. The bearing brackets 30 should preferably be spaced at intervals of about 4 to 5 feet both lengthwise and widthwise. A secondary structural member, such as a "zee" purlin 38 (FIG. 2), is secured along each horizontal line of bearing brackets 30 to the top of each bearing bracket so as to be parallel to the roof ridge line. The roof panels 20 are assembled to the top of the "zee" purlins 38 with their corrugations running perpendicular to "zee" purlins 38. Although roof panels 20 are corrugated, the height of the individual ridges is small in comparison to the size of the roof, thus the roof panels are considered to be substantially planar. Once assembled, roof panels 20 and purlins 38 form a roof panel assembly 21 (FIG. 1). Each side 20*a*, 20*b* of roof 20 is separately installed and a gap remaining between sides 20*a*, 20*b* is covered by a centrally positioned ridge cap 24 providing a vent.

Figures 2, 2A:
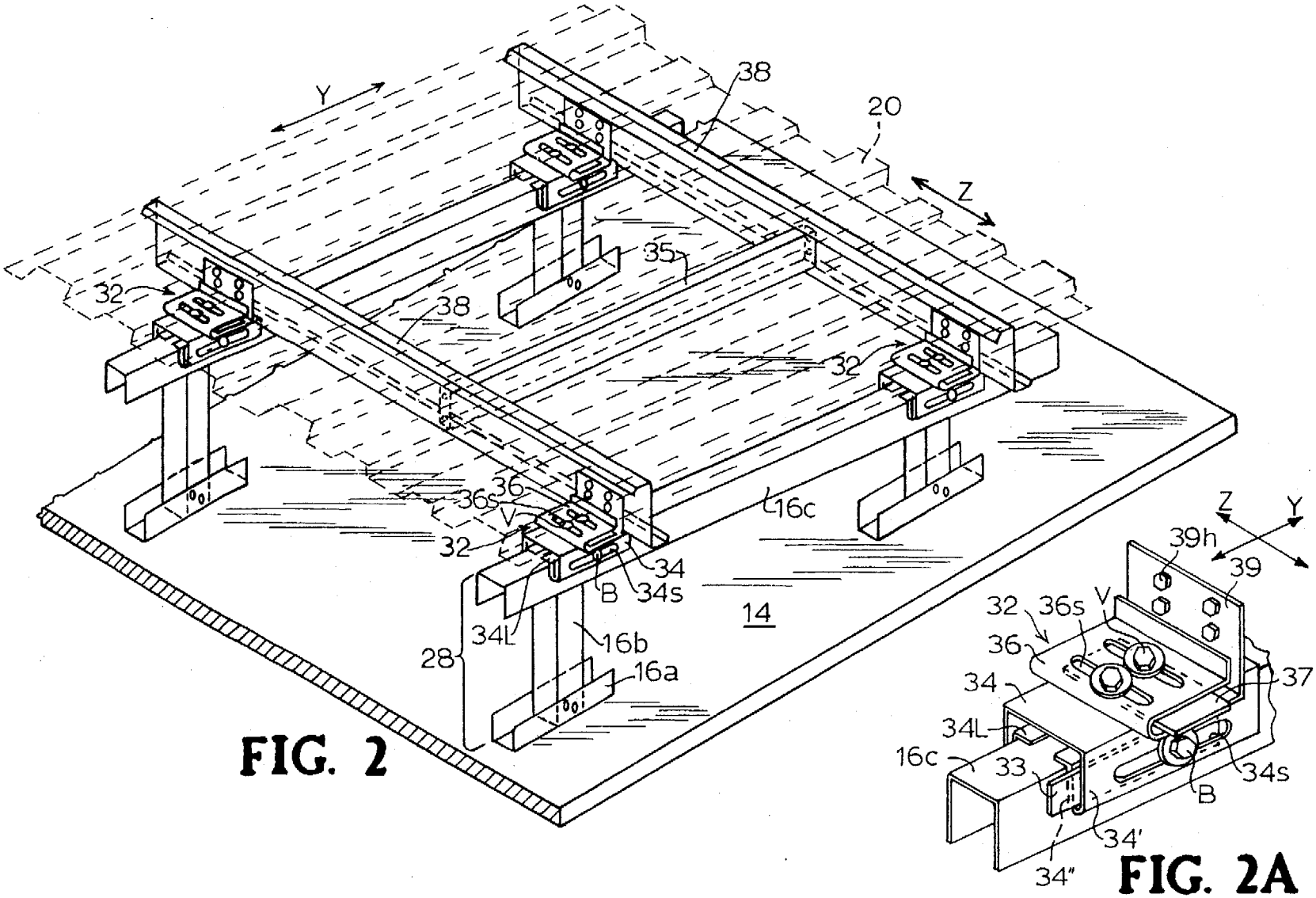
FIG. 2 is a perspective view of a portion of the roof of FIG. 1, a single representative roof panel being illustrated in dashed lines.
FIG. 2A is an enlarged perspective view of the bracket and mounting beam depicted in FIG. 2.

As illustrated in FIG. 1 and FIG. 2, the roof panel assembly freely expands and contracts along two axes by virtue of purlins 38 being mounted on floating bearing brackets 30. Various embodiments of bearing brackets 30 are adapted to attach to differing structural members in building 10 and to allow freedom of movement along either one axis or two mutually perpendicular axes. The determination of whether to install uni-axial or bi-axial freedom brackets 30 is based, typically, on several factors, including the climate and building design.

FIG. 2 shows a segment of pre-existing roof 14 with a steel framework 28 attached by any conventional means. Framework 28 includes multiple assemblies each having a foot 16*a*, column 16*b* and rafter 16*c*. A number of bi-axial floating bearing brackets 32 are mounted on each rafter 16*c* to support, in turn, "zee" purlins 38 and typical corrugated roof panel 20 on support angle 36. As used below, a suffix "h" to an identifying part number denotes a hole in the corresponding part; suffix "s" denotes a slot; and suffix "r" denotes a rim (or lip). Each bracket 32, a detail of which is shown in enlarged view in FIG. 2A, comprises a saddle base 34 with longitudinal slots 34*s* and support angle 36 with transverse slots 36*s* so that support angle 36 is able to move in direction Z while saddle base 34 moves in direction Y. A vertically positioned slide plate 33 is located in a channel formed between the vertical doubled back side wall portions on each side of slider 34. Slide plate 33 has a single bolt hole substantially through its center. As shown in assembly in FIG. 2A, bolt B passes through slots 34*s* formed in both outer wall 34' and inner wall 34" of slider 34 and the hole (not shown) in slide plate 33 and the respective vertical wall of rafter 16*c*. In this manner, slider 34 is free to move to the extent of slot 34*s* while slide plate 33 remains stationary with rafter 16*c*. Slide plate 33 primarily serves to distribute the force of a wind induced lift along the length of slider 34. Support angle 36 is assembled to the top surface of slider 34 by bolts V passing through slots 36*s*, oriented transverse to slots 34*s*. A slide plate 37 is positioned between the lower and upper panels of support angle 36 and has holes (not shown) to match slots 36*s*. Perpendicularly bent back wall 39 has a number of holes 39*h* for attachment to "zee" purlin 38 (see FIG. 2). Laterally installed bolts B are positioned at a height which enables each saddle base 34 to maintain clearance above the respective rafter 16*c* to allow vertically installed bolts V free movement. Inwardly directed lips 34L slidingly engage the top surface of the respective rafter 16*c*. Although bearing brackets 32 are illustrated as being installed in alignment with columns 16*b*, installation positions intermediate such columns is similarly effective. When roof panels 20 (shown in dashed lines) are mounted fixedly to "zee" purlins 38, typically by screws or rivets (not shown), purlins 38 and the roof panels 20 form a rigid composite unit which is floatingly supported above frame 28 on bearing brackets 32. Additional rigidity may be imparted to the roof assembly described by the use of a number of structural braces 35 fixedly attached between consecutive purlins 38. Expansion or contraction, portrayed in axial directions Y and Z (as shown by arrows) will be accommodated without stress to the attaching fasteners or the roof panels. The secure mounting by bolts or rivets prevents movement of roof panels 20 in the vertical direction, thus sustaining the roof against wind lift.

Figure 3:
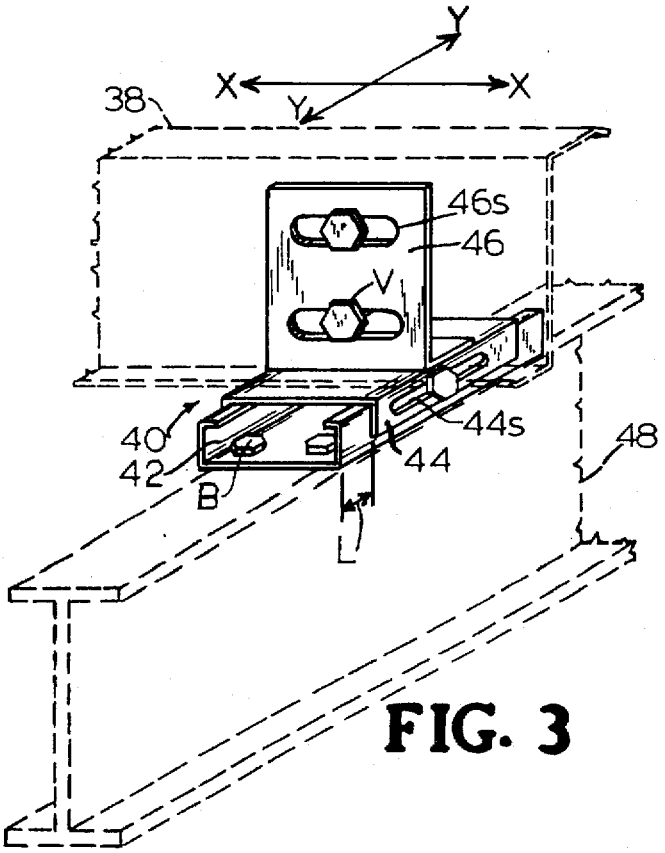
FIG. 3 is a perspective view of a bearing bracket of a second embodiment of the invention mounted on a first beam (in dashed lines) and supporting a "Zee" purlin (in dashed lines) in bi-axially floating attachment.

FIG. 3 shows a further embodiment of the invention bi-axial floating bearing bracket. As shown, bracket 40 includes channel base 42, adapted to mount upon a girder 48 (shown in dashed lines) by means of bolts B or by welding. Bracket 40 supports a "zee" purlin 38 (shown in dashed lines) in a similar manner to that shown with respect to bracket 32 in FIG. 2. A corrugated roof panel which is typically mounted to "zee" purlin 38 is not shown for reasons of clarity. Saddle slider 44 is configured to slidingly straddle channel base 42 with slots 44*s* in the walls of saddle slider 44 extending parallel to channel base 42 so to allow movement of the magnitude of length L on either side of center. A perpendicularly positioned support angle 46 is rigidly secured to saddle slider 44 and extends upwardly from saddle slider 44 to mount "zee" purlin 38 by bolts V through transverse slots 46*s*. Bolts B and V are installed to hold the respective parts together while allowing free sliding motion. As is evident, the combination of perpendicularly oriented slots 44*s* and 46*s* will permit relatively free movement in both directions indicated by arrows X—X and Y—Y without permitting vertical lift. In all embodiments of the present invention, choice of uni-axial or bi-axial movement is at the discretion of the designer through use of bolt hole or slot opening configurations in the several surfaces of the bracket.

In order to retain a freedom of movement in the desired direction while preventing excessive movement in other directions, a fastener capable of fixed shank length is preferred. Among this type fastener class, friction locking nuts, double nuts, shoulder bolts and rivets are representative of the preferred form.

Figure 4:
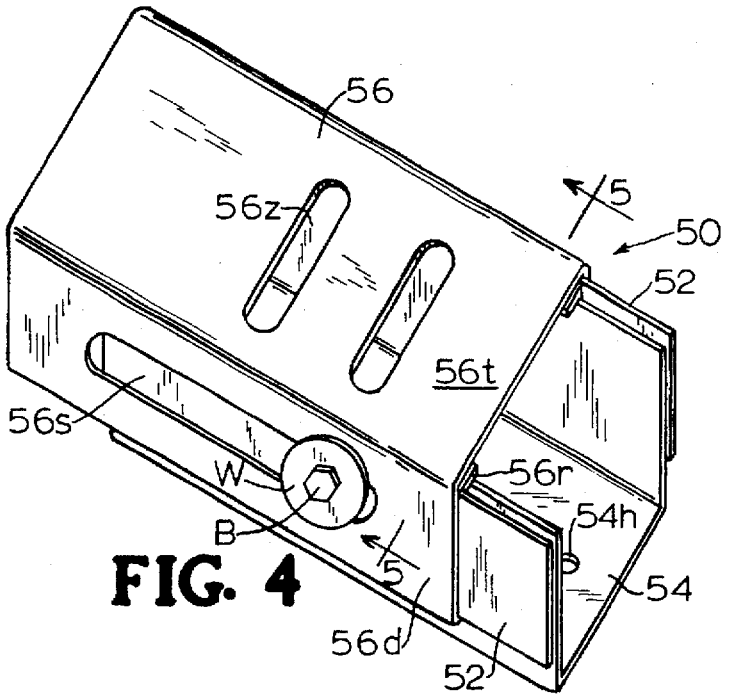
FIG. 4 is a perspective view of a bearing bracket of a third embodiment of the invention.
Figure 5:
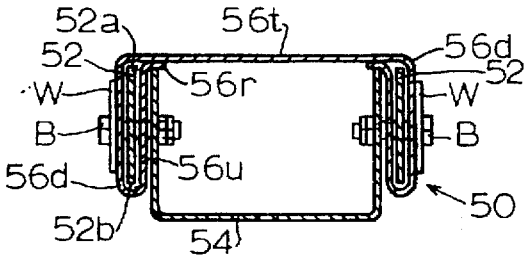
FIG. 5 is a cross sectional view of the bearing bracket of FIG. 4 taken in the direction of line 5—5 thereof.

An alternative floating bi-axial bearing bracket 50 is illustrated in detail in FIG. 4 and in cross section in FIG. 5. Bracket 50 has a channel base 54 which is formed as an upwardly open simple "U" shape with two or more mounting holes 54*h* in its mounting wall. Channel base 54 can be secured to a substrate existing roof or structural frame. Saddle slider 56 is in the form of a modified, inverted channel, which is formed with its downwardly extending slider walls 56*d* (see FIG. 5) bent in a moderately close curve to return 180° to form upwardly extending inner walls 56*u* which terminate with inwardly facing, horizontal rims 56*r*. The spacing between panel 56*d* and panel 56*u* is sufficient to slidingly accommodate slide plate 52 so that, as assembled, the bottom edge 52*b* of slide plate 52 is slightly above the transition curve between panels 56*d* and 56*u* while its top edge 52*a* is spaced apart from the inner surface of top panel 56*t*. Saddle slider 56 is further formed with longitudinal slots 56*s* through its side walls and transverse slots 56*z* through its top panel 56*t*, as drawn. A "zee" purlin or similar roof panel structural member is secured to the top wall of slider 56 by bolts or the like which pass through slots 56*z*.

When assembled, as illustrated, rims 56*r* slidingly ride on the top edges of the side walls of channel base 54. Bolt B, mounting a flat washer W, passes through longitudinal slots 56*s* on either side of saddle slider 56 and through a hole (not shown) in slide plate 52, in a fashion to allow free relative movement. Each sliding plate 52 and both vertical sides of channel base 54 have a hole through its center through which bolts B pass so that when saddle slider 56 moves relative to channel base 54, slide plate 52 retains its position relative to channel base 54. When movement occurs due to expansion and contraction of the roof panels, the major bearing force occurs along the length of rims 56*r*. When a lifting force occurs to the roof structure because of wind, the lower edge 52*b* of slide plate 52 acts to resist the lift. The presence of rims 56*r* and slide plates 52 avoids concentrated loads as would otherwise occur if the bolts B were the only component supporting saddle slider 56 on channel base 54.

Figure 6:
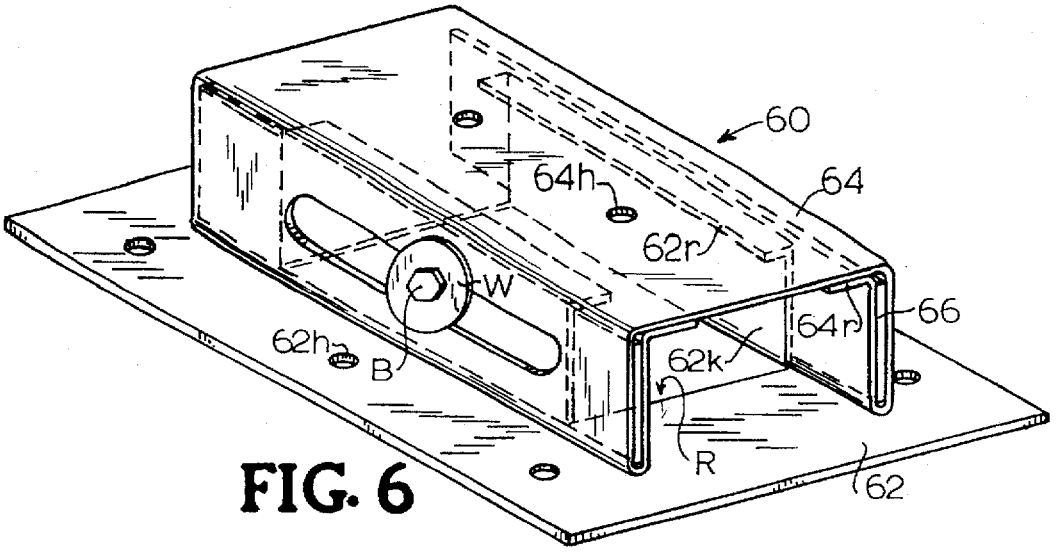
FIG. 6 is a perspective view of a bearing bracket according to a fourth embodiment of the invention.

A further embodiment of the invention is bearing bracket 60, shown in FIG. 6, wherein a base member 62 is formed from a plate with a rectangular hole R punched in a manner to form perpendicularly bent sides 62*k*, each having a central hole (not shown) and an inwardly directed rim 62*r*. Saddle slider 64 is formed similarly to slider 56 of FIG. 4 and has inwardly directed rims 64*r* which are adapted to ride on rims 62*r*. A slide plate 66 operates and fits similarly to that described above. Each slide plate 66 has a hole through which bolt B (only one shown) passes. Being formed with round holes 64*h* in the top panel of saddle slider 64, this embodiment is configured to permit uni-axial floatation for a mounted roof system. Mounting holes 62*h* in base member 62 are positioned to permit access when inserting mounting bolts or other fasteners so as to secure base member 62 to the old roof or new frame.

Figure 7:
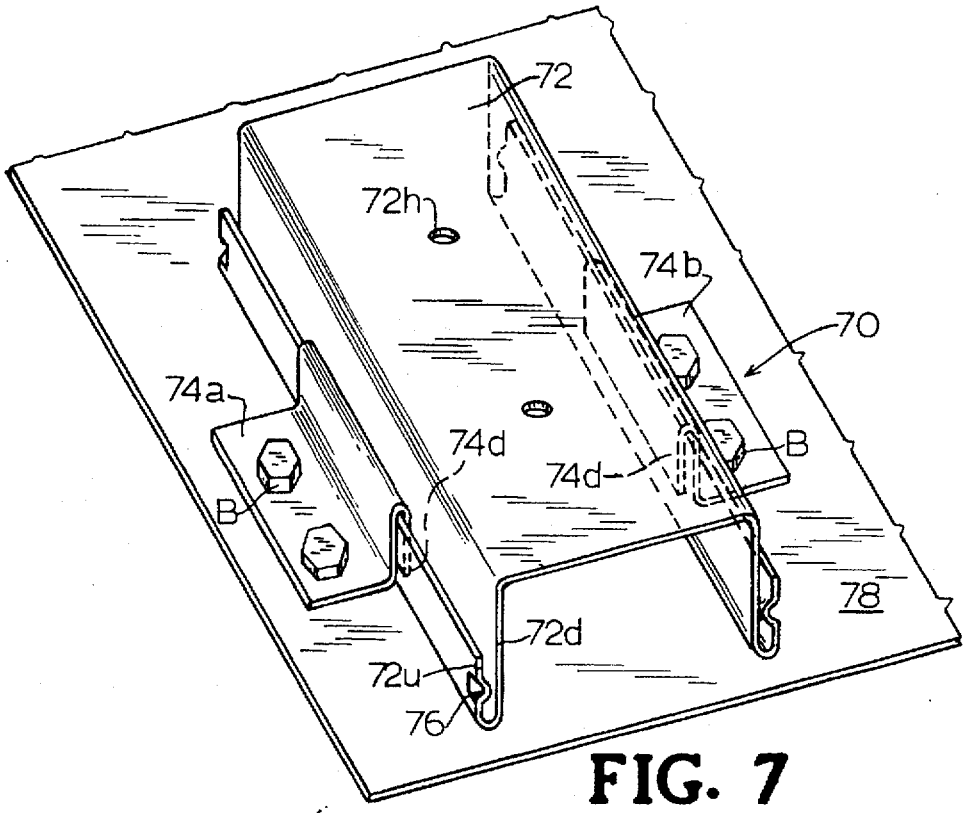
FIG. 7 is a perspective view of a bearing bracket according to a fifth embodiment of the invention.

An additional embodiment of the invention is illustrated in FIG. 7 as bearing bracket 70, comprising saddle slider 72 and a pair of clamps 74*a*, 74*b* adapted to engage therewith. Saddle slider 72 is formed with downwardly directed side walls 72*d* extending to form a pair of spaced apart mirror-image slider legs with outwardly and upwardly bent panels 72*u* with sufficient space between to insert a downwardly directed panel 74*d* of each clamp 74*a*, 74*b*. The longitudinal ends of panels 72*u* are deformed by punch bending, or are welded, to provide a stop 76 capable of preventing saddle slider 72 from moving beyond the limits set by clamps 74*a*, 74*b*. One or more bolts or screws B screwed securely through holes in each clamp 74*a*, 74*b* mounts bearing bracket 70 to a prior roof panel or a structural member 78. A fastener placed through holes 72*h* in the top surface of saddle slider 72 will serve to securely attach a new panel support framing member (not shown).

Figure 8:
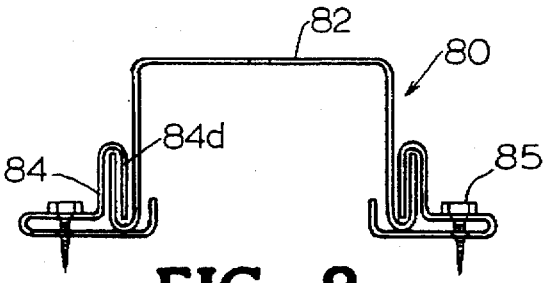
FIG. 8 is an end elevation view of a bearing bracket according to a sixth embodiment of the invention.
Figure 8A:
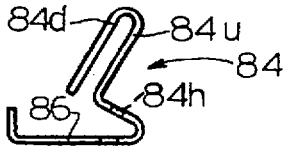
FIG. 8A is an end view of a clamp used in the embodiment of FIG. 8 in the unassembled condition prior to being placed into the position shown in FIG. 8.

The bearing bracket 70 of FIG. 7 has the lowermost edges of slider 72 bearing on the substrate 78 below. In some instances, this may be undesirable because of excessive wear to substrate 78. This wear potential is overcome with the design shown in FIG. 8 of a further embodiment of the invention. Bearing bracket 80 provides a saddle slider 82 formed similarly to slider 72 of FIG. 7. Clamp 84 (see FIG. 8A) has a further bearing plate 86 which is formed to extend below the lower edge of slider 82 when assembled. One or more bolts or screws through holes 84*h* serve both to close clamp 84 and fasten bracket 80 to the structure below. As illustrated, the length of downwardly directed panel 84*d* is such as to remain in spaced relation to slider 82 and permit free sliding motion. The number of bolts or screws 85 used to anchor this and other embodiments of the invention depends on the anticipated stress, the materials of each part and the fastener size.

Figure 8B:
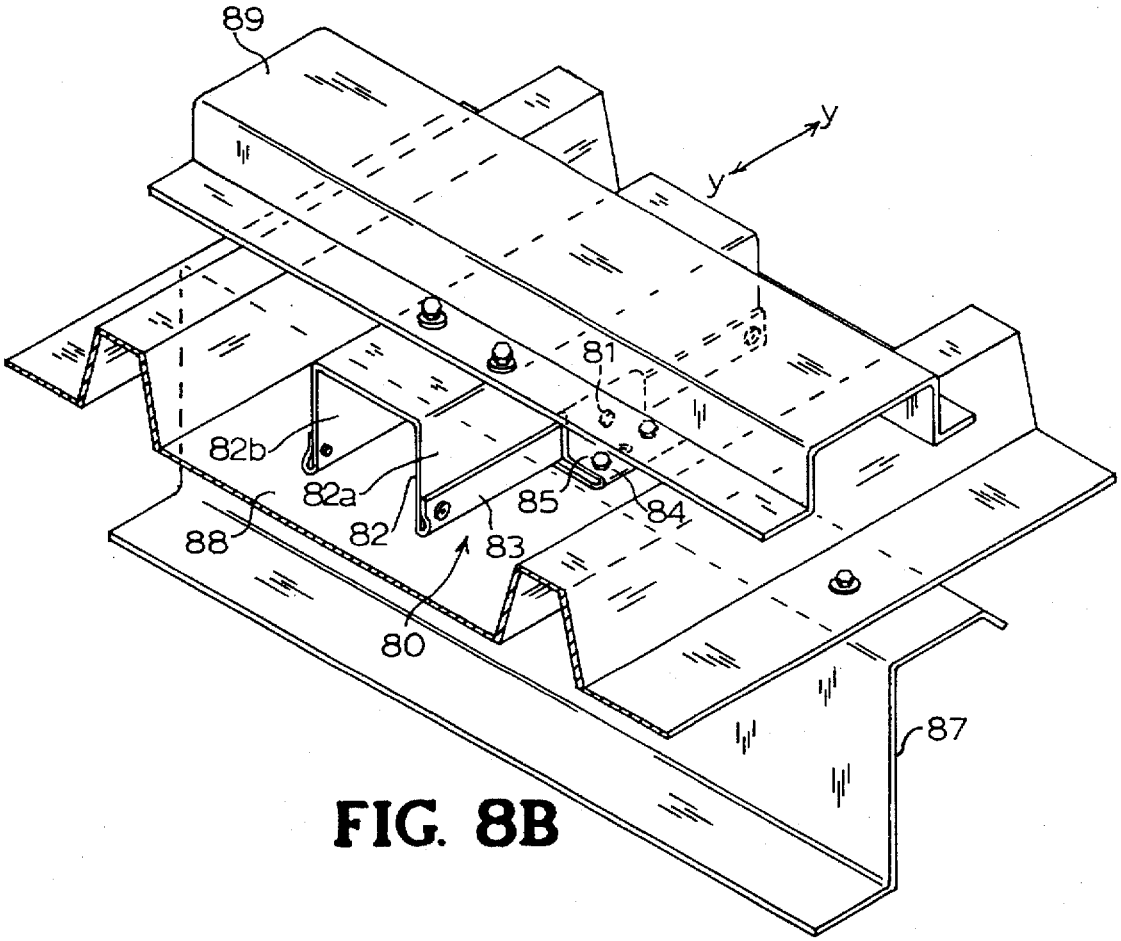
FIG. 8B is a perspective view of the bearing bracket of FIG. 8 mounted on a pre-existing corrugated roofing panel and having a frame member for supporting a new roof member fixedly mounted thereon for uni-axial movement.
Figure 8C:
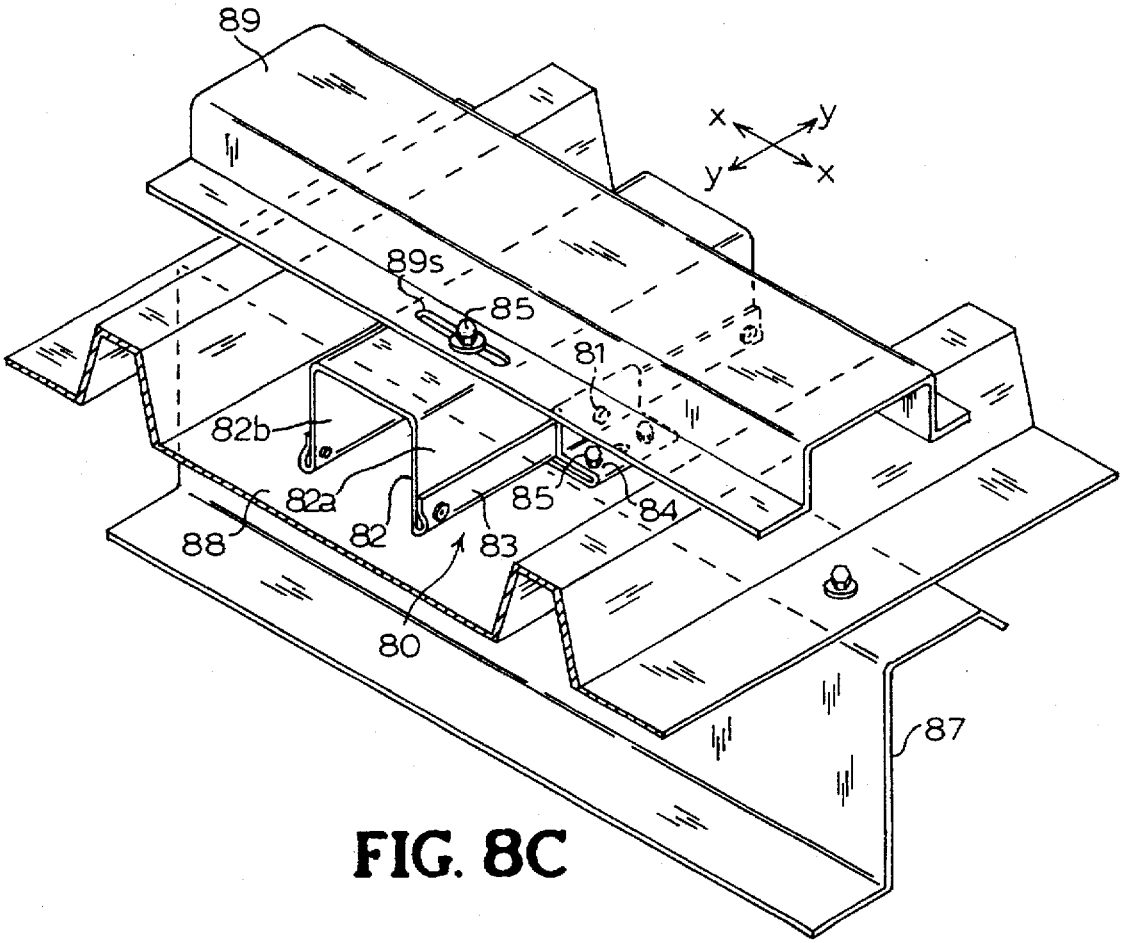
FIG. 8C is a perspective view of the bearing bracket of FIG. 8 mounted on a pre-existing corrugated roofing panel and having a slotted frame member slidingly mounted thereon for supporting a new roof member for bi-axial movement.
Figure 8D:
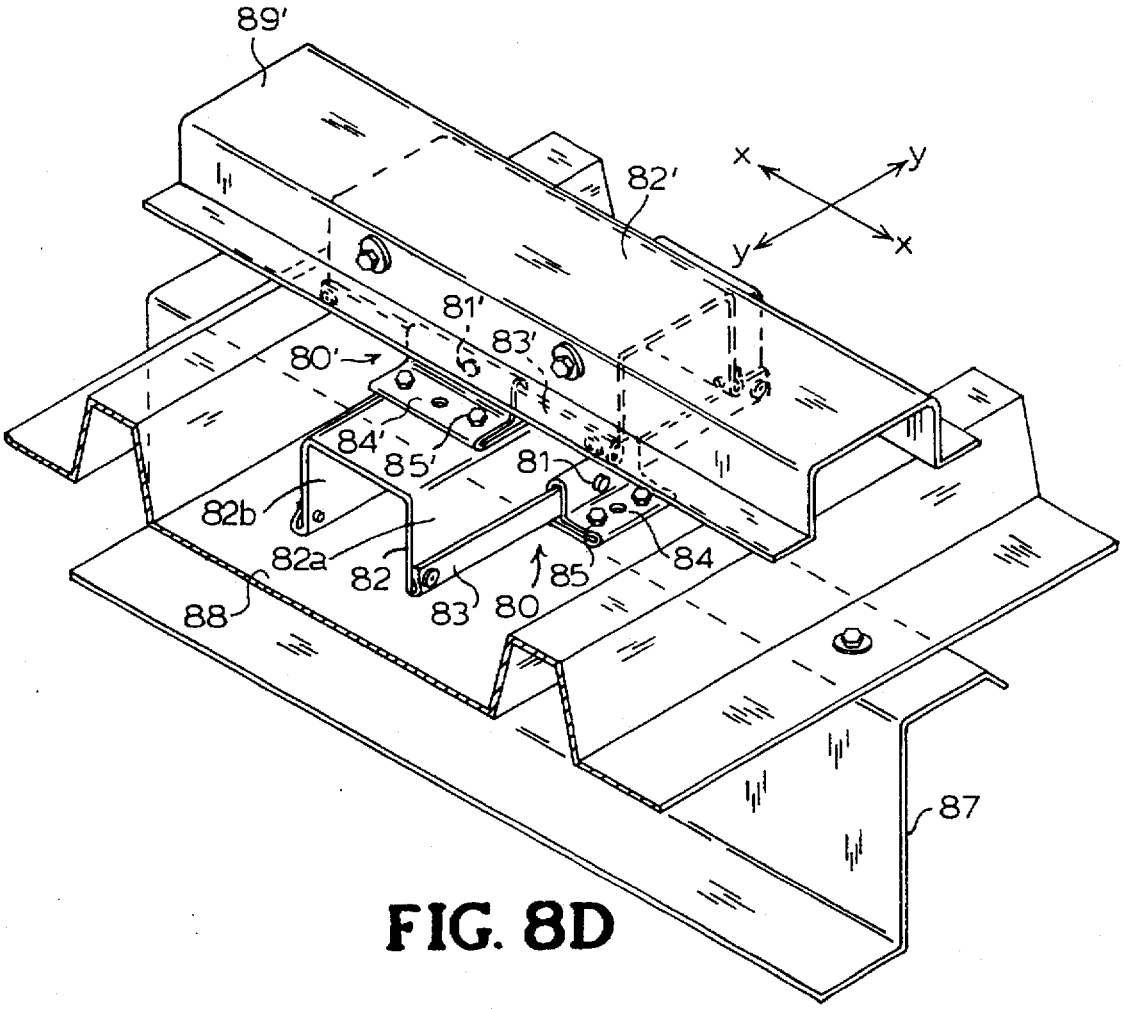
FIG. 8D is a perspective view of a pair of bearing brackets of FIG. 8 assembled in double layer fashion with one bracket mounted perpendicularly upon the other and the pair mounted on a pre-existing corrugated roofing panel and having a frame member for supporting a new roof member fixedly mounted thereon for bi-axial movement.

Several modes of utilization of a modified version of bearing bracket 80 are illustrated in FIGS. 8B, 8C and 8D. Bracket 80 has been modified to include a connective link, such as centering pin 81 which is inserted through a preformed hole in clamp 84 and the adjacent hem 83 of saddle slider 82. Saddle slider 82, as disclosed above, is formed with a pair of spaced apart legs 82*a*, 82*b* which ride on a lower plate 86 of clamp 84 (see FIGS. 8, 8A). Centering pin 81 is inserted with clamp 84 approximately centered relative to saddle slider 82. Centering pin 81 is made of a material which will readily break under stress, such as during thermal expansion of the new roofing panel. In that way, when a series of brackets 80 are mounted to a roof panel 88 along a selected line, all sliders 82 will be positioned relative to clamps 84 so as to permit a similar range of movement in each bearing bracket.

With reference first to FIG. 8B, bearing bracket 80 comprises saddle slider 82 and a pair of clamps 84. Bearing bracket 80 is shown assembled to existing corrugated roofing panel 88 by means of clamps 84 with fasteners 85. It is preferred that bearing bracket 80 is connected to roofing panel 88 in a position with each clamp 84 located on the upper surface of roofing panel 88 along the length of supporting purlin 87 so that fasteners 85 are installed through both roofing panel 88 and purlin 87 for strength and stability. An added advantage to installation of building brackets along the lines of the supporting purlins is that fewer brackets are needed because of the rigidity of the purlin, saving both materials and labor. Saddle slider 82, as seen mounted in FIG. 8B, is oriented parallel to the corrugations of roof panel 88 so as to allow frame member 89 and a new roofing panel member (not shown) to move in the direction indicated by arrow Y—Y under the application of excess stress to break pin 81.

A further use of the bearing bracket of the invention involves providing for movement of a roofing panel or other planar building component in two substantially perpendicular directions. Such an application is shown in FIG. 8C, where bearing bracket 80 is mounted to existing roofing panel 88 in similar manner to that described above in relation to FIG. 8B. In FIG. 8C, frame member 89 is provided with a series of slots 89*s* formed in planar flanges thereof. Each of the slots is positioned to coincide respectively with each bearing bracket 80 and oriented parallel to the long dimension of frame member 89. A sheet metal screw or bolt 85 is passed through each slot 89*s* and loosely fastened to the planar top surface of bearing bracket saddle slider 82. In that manner, saddle slider 82 is free to move in a direction indicated by arrow Y—Y, and frame member 89 is free to move in a direction indicated by arrow X—X. Thus, bi-axial freedom of movement is accomplished for frame member 89 with an attached new roofing panel (not shown) mounted thereupon.

An alternate mode of operation of bearing bracket 80 to achieve bi-axial freedom of movement is shown in FIG. 8D where a second bearing bracket 80' is mounted in double layer fashion and in perpendicular relation onto bearing bracket 80. Whereas clamp 84 of bearing bracket 80 is of a similar width to the width of the flat top surface of purlin 87 to which it is attached, clamp 84' of bearing bracket 80' is similar in width to the width of the flat top surface of lower bearing bracket 80 to which it is mounted. Centering pins 81, 81' aid in proper mounting placement as described above. As shown, this double layer fashion assembly allows bi-axial freedom of movement in response to thermal changes or other stress in the direction of lines X—X or of Y—Y.

By allowing framing member 89' of FIG. 8D to move bi-axially in response to the expansion or contraction of roofing panels (not shown) due to thermal or other stress, the roofing panel and its supporting framework sustain less damage and have a longer use life.

Figure 9:
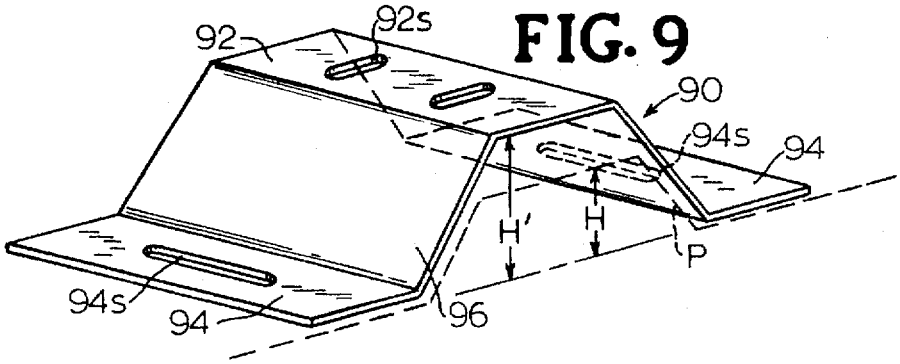
FIG. 9 is a perspective view of what is referred to as a hat slider bearing bracket of a seventh embodiment of the invention having two pairs of mutually perpendicular slots permitting bi-axial movement of the roof panels (not shown).
Figure 10:
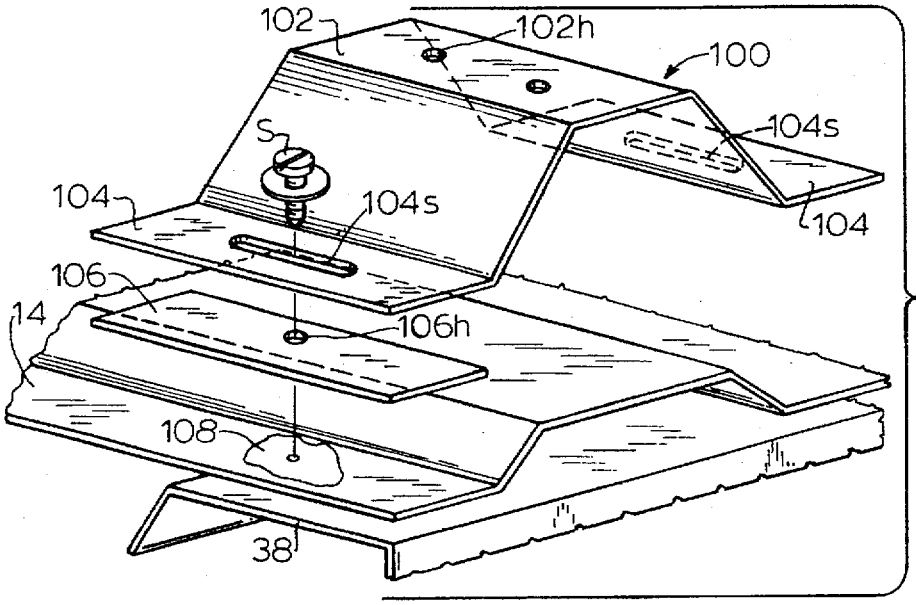
FIG. 10 is an exploded perspective view of a hat slider bearing bracket according to an eighth embodiment having a single pair of parallel slots and a pair of bolts (only one being shown) in position to be assembled onto a pre-existing roof unit permitting movement of roof panels (not shown) along a single axis.
Figure 11:
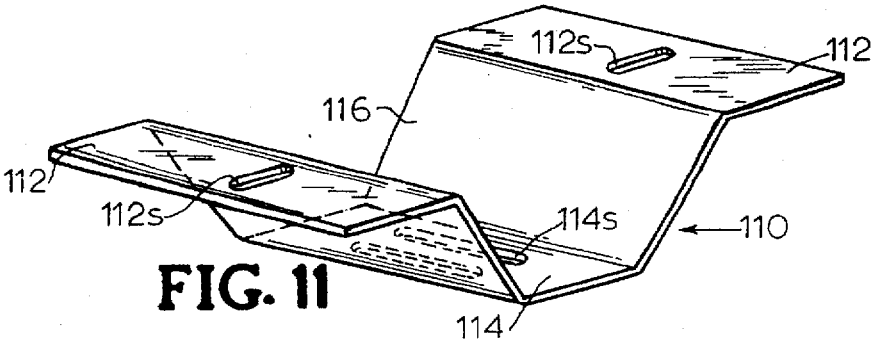
FIG. 11 is a perspective view of a hat slider bearing bracket of the invention according to a ninth embodiment wherein two pairs of slots are oriented opposite to those in the embodiment of FIG. 9.

Several embodiments of the invention, particularly adapted to be used in conjunction with an existing or new corrugated metal sheet roof are illustrated in FIGS. 9, 10 and 11. Slider 90 of FIG. 9, in the cross sectional form of a hat section and referred to as a "hat slider" has a pair of parallel slots 94*s* formed in coplanar side panels 94 to allow longitudinal movement parallel to the corrugations of the existing roof panel P (shown in dashed lines). Upper panel 92 has a pair of slots 92*s* which are parallel to each other and perpendicular to the slots 94*s* so as to allow movement of a mounted roof panel along a second axis. The height H' of upper panel 92 is greater than height H of a corrugation in existing roof panel P so as to permit the lower ends of bolts (not shown) placed through slots 92*s* to remain clear of roof panel P and permit hat slider 90 to move freely.

As in other embodiments of the invention, the hat slider type bracket is also susceptible to installations which require linear freedom in a single axial direction. The illustration of FIG. 10 shows an adaptation wherein round holes 102*h*, rather than slots, are formed in panel 102. In this way, hat slider 100 is able to move parallel to the length of slots 104*s* formed in panels 104, but hold against movement in other directions by the new roof replacement panel (not shown) being secured through the holes 102*h*. When mounting hat slider 100 to an existing roof 14, as illustrated in exploded view in FIG. 10, a sealant 108 is applied to the area where a mounting hole is to be made. Slide plate 106, having center hole 106*h* is placed over sealant 108, and screw S is passed through slot 104*s* and hole 106*h* to slidingly anchor each lateral panel 104 of hat slider 100.

FIG. 11 illustrates a further modified hat slider type bracket 110 with the orientation of slots 112*s*, 114*s* reversed in comparison to the embodiment of FIG. 9. As shown, central panel 114 is positioned to mount on a substrate member, although hat slider 110 could be turned over and mounted with panels 112 in contact with a support surface. The illustrated hat slider brackets shown in FIGS. 9, 10 & 11 are portrayed of fixed, comparatively short length. The invention also recognizes that said configurations are susceptible to long length slider members as shown and described in relation to FIGS. 15, 15A.

Figure 12:
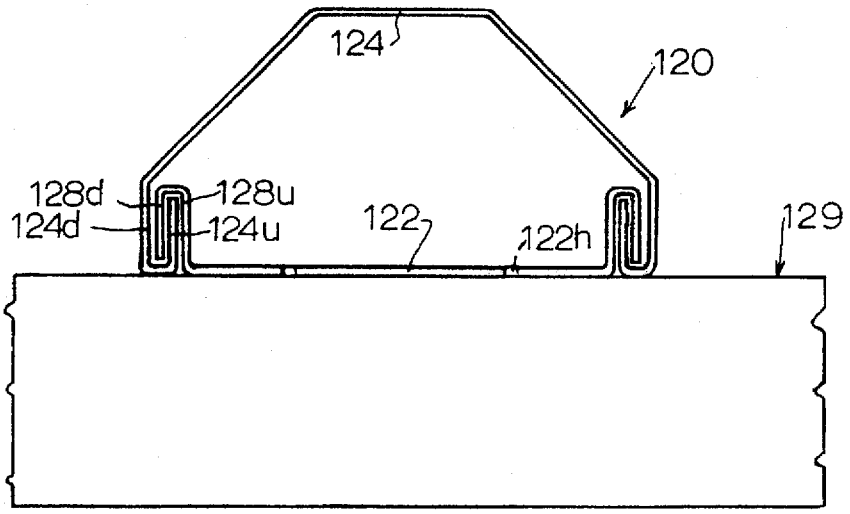
FIG. 12 is an end elevation view of an alternative style hat slider bearing bracket according to a tenth embodiment of the invention permitting movement of roof panels (not shown) along a single axis.
Figure 12A:
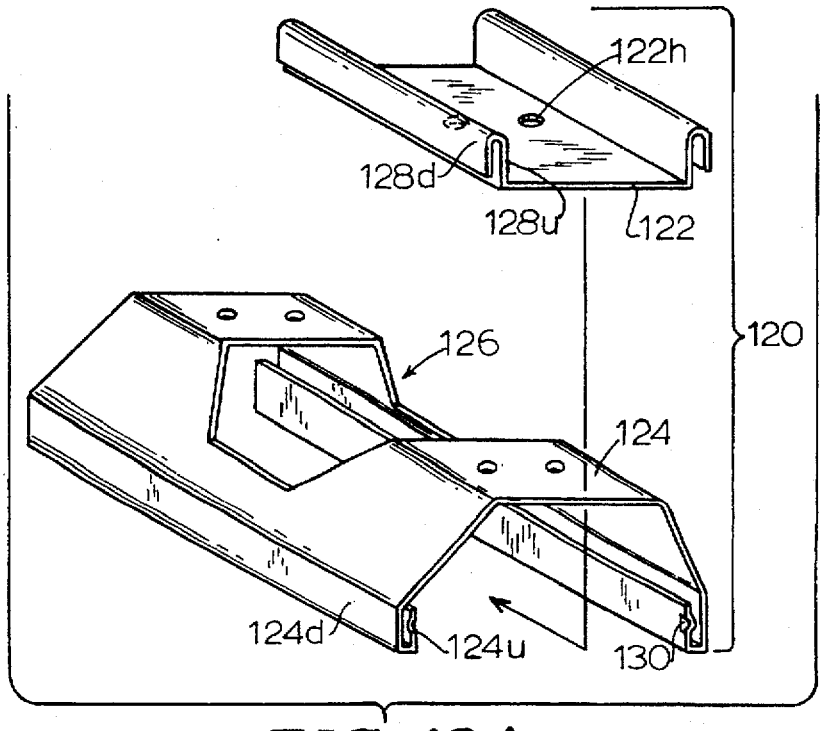
FIG. 12A is a perspective exploded view of the hat slider bearing bracket of FIG. 12.

The invention further recognizes that a slider may be formed similar to that illustrated and discussed above with the interengaging slide portions formed inwardly of the side walls. Such an embodiment is shown in FIGS. 12 and 12A wherein hat slider type bearing bracket 120 includes hat slider 124 formed with downwardly extending side walls 124*d* and inwardly and upwardly bent inner walls 124*u* formed parallel thereto. Conversely, clamp member 122 has a pair of upwardly bent parallel side walls 128*u* and downwardly bent outer lips 128*d* which are shorter in height and configured and spaced so as to engage inner walls 124*u* of hat slider 124. Clamp 122 is further formed with mounting holes 122*h* to be secured to a substrate surface 129. Hat slider 124 is adapted with window 126 to permit screw hole access. End stops 130 are formed after clamp member 122 has been placed into hat slider 124. Whereas hat bearing bracket 120 is formed to match the contour of an elongate structural hat section, the configuration of a bearing bracket having inwardly directed bent side walls may be also formed with side panels which are substantially perpendicular to its central, top panel (not shown).

Figure 13:
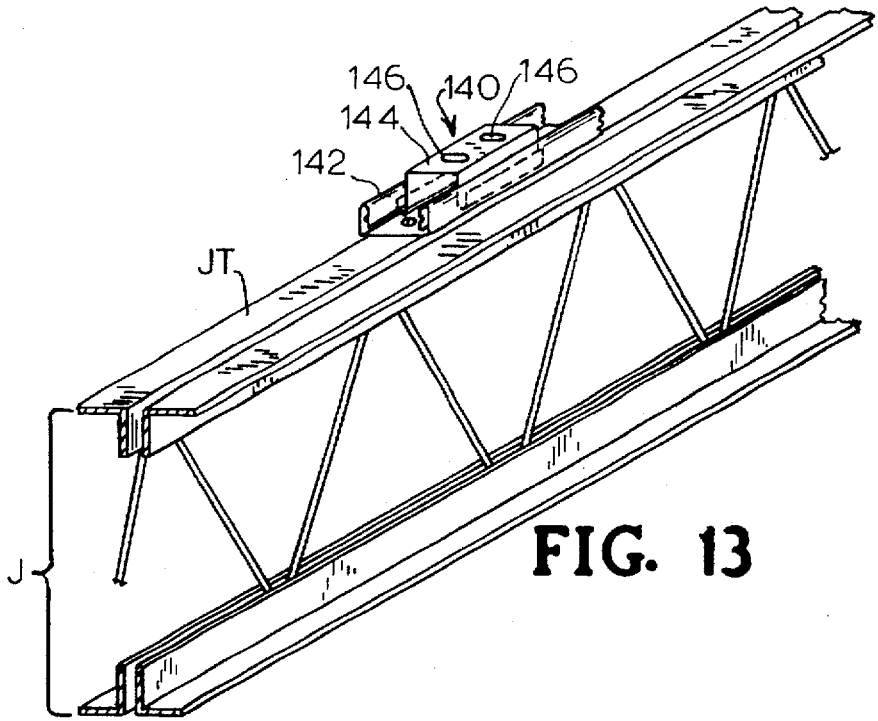
FIG. 13 is a perspective view of a further embodiment of the bearing bracket of the invention mounted on an upper surface of a bar joist.
Figure 14:
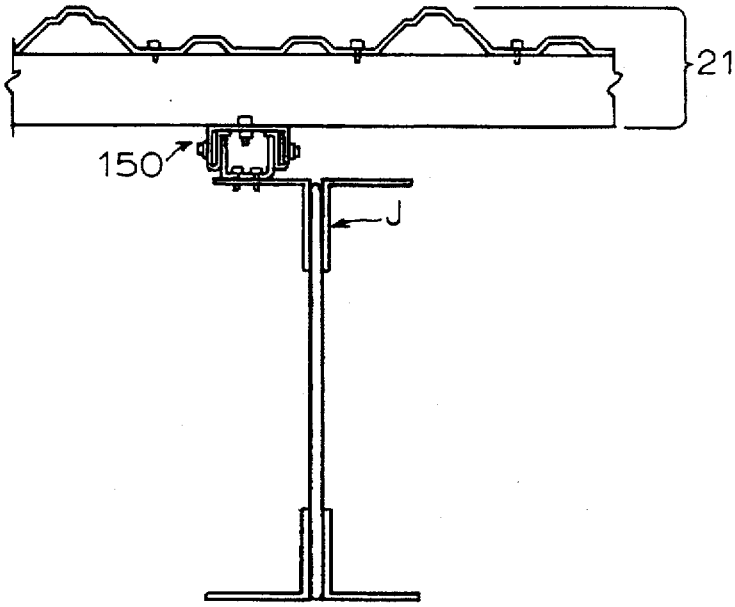
FIG. 14 is an end elevation view of the bearing bracket of FIG. 5 mounted on the bar joist and supporting a roof panel.

Making reference next to FIGS. 13–14, bar joists J, known in the art, comprised of a rigid elongate upper member connected to a parallel, rigid elongate lower member by a series of angularly disposed brace members to form a unitary structural beam, are commonly used, particularly for the support of roofing membranes. Such a bar joist J is illustrated with a bearing bracket 140 of the invention mounted on its top surface JT in FIG. 13. Bracket 140 has inverted channel base portion 142 which is adapted to bolt to joist top surface JT and slidingly contain slider 144. As mounted, slider 144 of bracket 140 is movable in a direction parallel to the length of bar joist J. Bearing bracket 140 has a pair of slots 146 in the top surface of slide 144 oriented perpendicular to the length of bar joist J for the slidable mounting of a framing member. The assembly shown in end view in FIG. 14 has roof panel 21 (including a framing member and a roofing panel) slidingly bolted through perpendicularly oriented slots of bracket 150 (described above as bearing bracket 50 of FIGS. 4 and 5), thus allowing roof panel 21 to move perpendicular to the length of joist J as well as parallel thereto.

Figure 15:
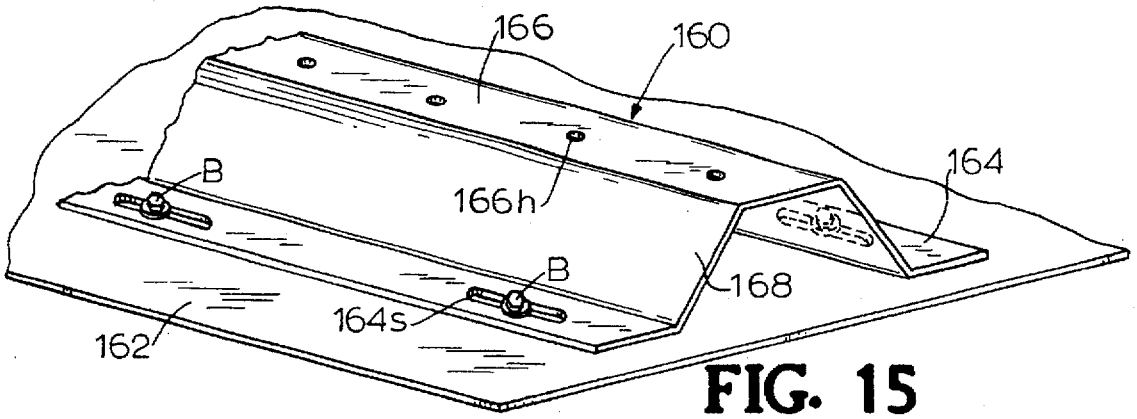
FIG. 15 is a segmented perspective view of an elongate hat section beam anchored to a surface by fasteners through slots formed to permit limited linear movement.
Figure 15A:
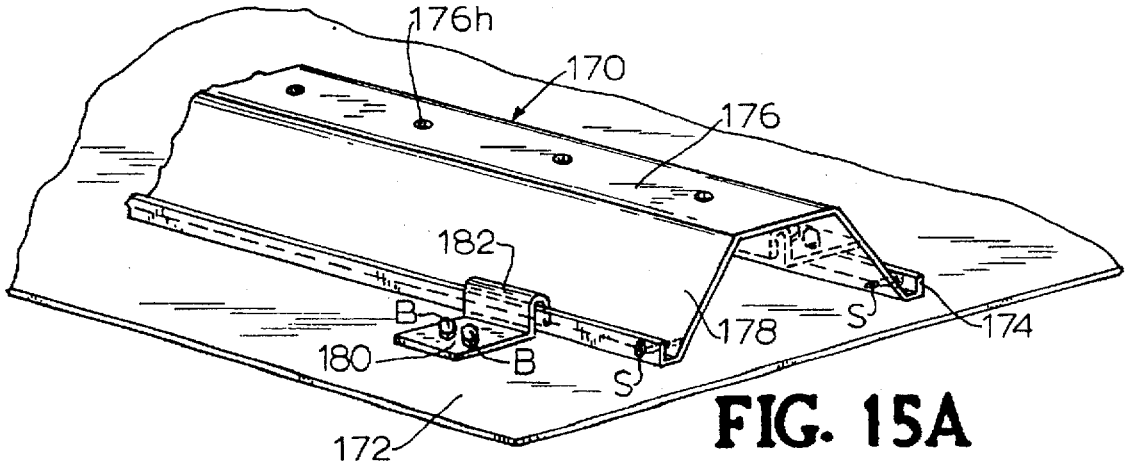
FIG. 15A is a segmented perspective view of a modified hat section beam having its lateral flanges bent upwardly and being anchored to a surface by a pair of clamps.

A further pair of embodiments is shown in FIGS. 15, 15A wherein bearing brackets employing the principles described above are formed from a standard full length hat section and a modified full length hat section, respectively. Referring now to FIG. 15, elongate hat section bracket 160 is formed of a unitary sheet to have two horizontal lateral panels 164, two angularly disposed panels 168 and one horizontal central panel 166. To permit linear movement of hat section bracket 160, a series of slots 164*s* is formed in lateral panels 164 so as to receive screws or bolts B for anchoring in slidable relation to substrate 162. A series of holes 166*h* is formed in panel 166, to assemble a roof panel, either directly to hat section bracket 160 or by a composite roof panel including a supporting "zee" purlin or the like (not shown). The roof panel-supporting purlin may, optionally, be also assembled by use of transverse slots in panel 166 (not shown), thus affording bi-axial motion to the mounted roof panel.

FIG. 15A shows a modified long hat section bracket 170 which has flanges 174 directed vertically upward. Angular panels 178 and horizontal central panel 176 are according to standard hat section configuration, including mounting holes 176*h*. Hat section bracket 170 is secured in sliding relation to substrate 172 with a series of clamps 180, secured by bolts B. Clamps 180 have a bent end portion 182 configured to engage flange 174. One or more stops, such as screws S are installed through flanges 174 to limit the movement of hat section bracket 170. Other structural members, such as "zee" or "C" purlins may also be adapted to function as bearing brackets, such as shown with hat section beams in FIGS. 15 and 15A. Hat section bracket 170 may function to support a roof panel or a roof panel assembled to a supporting "zee" purlin, or the like (not shown) as described in reference to FIG. 15 above. In addition, either standard hat section 160 of FIG. 15, or modified hat section 170 of FIG. 15A, may be mounted transversely on a bearing bracket, such as bracket 50 (see FIG. 4) or 70 (see FIG. 7) to provide a bi-axial movement for an assembled roof panel relative to a stationary supporting building component.

Figure 16A:
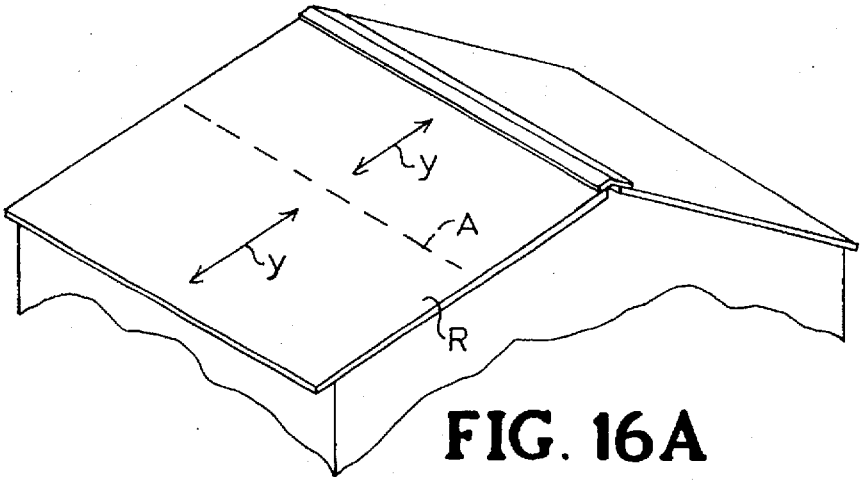
FIG. 16A is a schematic perspective representation of a roofing panel which is fixedly connected to a supporting structure along a line mid-way up its slope (shown as a dashed line), leaving portions above and below the line free to move by being mounted on bearing brackets of the invention.
Figure 16B:
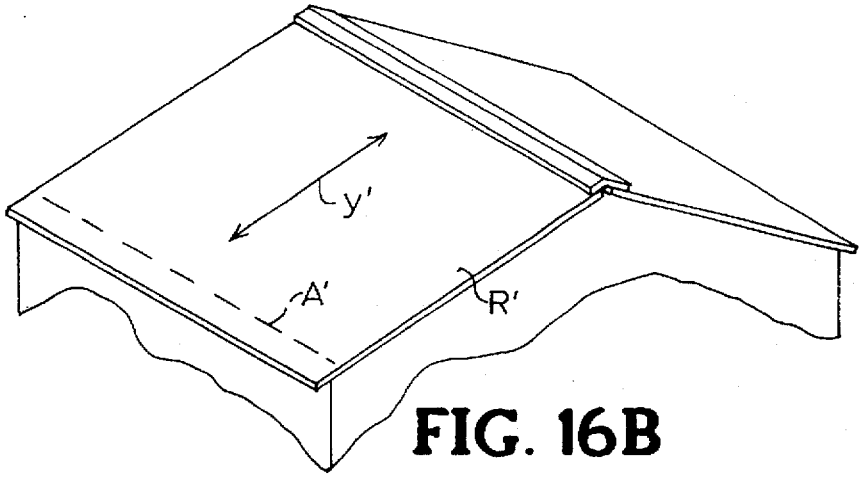
FIG. 16B is a schematic perspective representation of a roofing panel which is fixedly connected to a supporting structure along a line near the base of its slope (shown as a dashed line), leaving the portion above the line free to move by being mounted on bearing brackets of the invention.

The invention recognizes that it is preferable in some circumstances to install a roof panel with one portion fixedly anchored to a supporting structure, rather than allowing the total roof to float, as could occur according to the present invention. A preferred installation, for example, with a roofing panel R as illustrated schematically in FIG. 16A, bi-lateral thermal dimensional change in a direction along its slope is accomplished by fixedly anchoring panel R to the roof supporting structure (not shown) along line A, which is substantially in the midpoint of the slope. Expansion and contraction may occur in the direction indicated by arrows Y—Y in both the upper and the lower portion of roofing panel R. Anchoring of roofing panel R along line A would involve installation of either a series of rigid blocks in a height equal to the height of bearing bracket 80, or installation of a bearing bracket 80 which has been disabled to prevent sliding by installation of a screw or the like between moving parts. Alternatively, a roofing panel may be anchored along an edge thereof, as in the case of line A' of roofing panel R', shown in FIG. 16B, allowing expansion or contraction only to one side of the anchoring line A' in a direction indicated by bi-lateral arrow Y'.

Figure 16C:
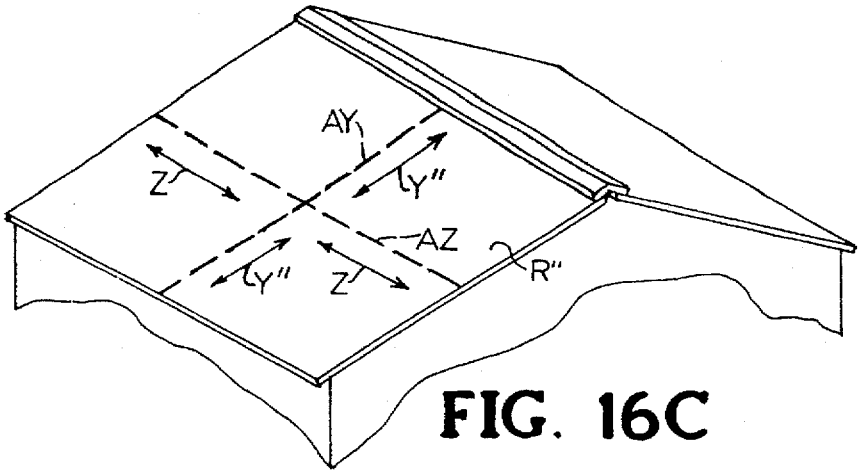
FIG. 16C is a schematic perspective representation of a roofing panel which is fixedly connected to a supporting structure along a pair of perpendicular lines (shown dashed) to allow the bi-axial movement of other portions while restricting movement along the lines.

When dealing with a double layer bracket which allows bi-axial expansion or contraction, such as that illustrated in FIG. 8D, movement of roofing panels freely in a plane is preferably accomplished according to the illustration of FIG. 16C. A first number of bi-axially free double layer bearing brackets are mounted along a first line AZ, which is located similarly to line A of FIG. 16A. A fastener or other disabling means to prevent sliding is applied to this first number of brackets to prevent movement in the direction indicated by arrow Y"—Y". A second number of bi-axially free double layer bearing brackets are mounted along a second line AY, which is oriented perpendicular to line AZ at its midpoint. A fastener is applied to this second number of brackets to prevent movement in the direction indicated by the arrow Z—Z. With this arrangement, point A", at the intersection of lines AY and AZ, remains stationery and locations other than lines AY and AZ are free to move bi-axially.

The various bearing bracket embodiments of the invention are formed of sufficiently strong sheet metal to sustain the stress to be applied. A typical range of sheet metal gauge is from 18 to 10 gauge.

As is evident from the variety of embodiments and configurations disclosed, the invention is susceptible to numerous modifications within the basic method of mounting a bearing bracket to a support base with limited linear freedom of movement, and then mounting a roof support framing member to the bracket and a roof panel is attached to the framing member. Further designs are particularly suited to use with vertical building panels. Thus, while the invention has been described with reference to specific embodiments thereof, it will be appreciated that the numerous variations, modifications, and embodiments possible, are to be regarded as being within the spirit and scope of the invention. When the roof panel is assembled directly to hat section bracket 160, hat section bracket 160 serves the dual function of being the roof support structure and the bearing bracket for providing limited movement relative to a stationary support substrate.

What is claimed is:

1. A method for allowing limited movement of a framing member to which a building panel is rigidly connected when said building panel changes dimensionally due thermal changes therein, comprising the steps of:

(a) supplying a first device having a pair of clamps engaged on each side member a U-shaped saddle slider and arranged for allowing limited movement of said framing member with said connected building panel in a selected direction relative to a stationary building component;

(b) fastening a first one of said pair of clamps to said stationary building component;

(c) fastening a second one of said pair of clamps to said stationary building component;

(d) fastening said framing member to said saddle slider in a manner to allow said framing member with said connected building panel to move a limited amount in said selected direction relative to said stationary building component; and (e) forming said framing member with a slot positioned for loosely receiving a fastener and assembling said fastener to said saddle slider so as to allow movement of said framing member with said connected building panel in a second direction substantially perpendicular to said selected direction.

2. A method for allowing limited movement of a framing member to which a building panel is rigidly connected when said building panel changes dimensionally due to thermal changes therein, comprising the steps of:

(a) supplying a first device having a pair of clamps engaged on each side member of a U-shaped saddle slider and arranged for allowing limited movement of said framing member with said connected building panel in a selected direction relative to a stationary building component;

(b) fastening a first one of said pair of clamps to said stationary building component;

(c) fastening a second one of said pair of clamps to said stationary building component;

(d) fastening said framing member to said saddle slider in a manner to allow said framing member with said connected building panel to move a limited amount in said selected direction relative to said stationary building component;

(e) supplying a second device having a second pair of clamps and a slidingly engaged saddle slider; and (f) assembling said second device by fastening said second pair of clamps to said first device so that said second device resides in perpendicular relation to said first device and between said first device and said framing member so as to permit bi-axial movement of said assembled framing member and said building panel relative to said stationary building component.

3. A bearing bracket for permitting limited movement of a substantially planar building panel attached to a framing member in a plane substantially parallel to a substantially planar supporting substrate on which said bracket is mounted, said bearing bracket comprising:

(a) a first member having a substantially planar first portion adapted to fixedly assemble to said supporting substrate;

(b) a second member having a substantially planar surface and a pair of spaced apart, mirror image legs each being adapted for slidingly engaging said first member;

(c) a framing member formed with a slot substantially parallel to a long dimension thereof; and (d) a fastener slidingly passing through said slot in said framing member to fixedly engage said substantially planar surface of said second member so that said framing member and its attached building panel are supported on said bearing bracket and are able to move a limited distance in a plane substantially parallel to said supporting substrate.

4. The bearing bracket of claim 3, wherein said first member comprises a substantially planar second portion which resides between said first portion and said supporting substrate and extends beneath a respective said leg of said second member so as to provide a bearing plate therefor.

5. The bearing bracket as described in claim 3, further comprising a breakable connective link mounted between said first member and said second member of said bearing bracket for temporarily preventing relative movement therebetween.

6. The bearing bracket as described in claim 5, wherein said breakable connective link is mounted so as to position said second member relative to said first member substantially at the mid-point of said limited distance through which said building panel is able to move.

7. A bearing bracket for allowing limited movement of a framing member to which a building panel is rigidly connected when said building panel changes dimensionally due to thermal changes therein, comprising:

(a) a first device having a first pair of clamps slidingly engaged with a first U-shaped saddle slider for allowing limited movement of said first saddle slider relative to a supporting substrate in a first selected direction, said first pair of clamps being fastened to a supporting substrate;

(b) a second device having a second pair of clamps slidingly engaged with a second U-shaped saddle slider for allowing limited movement of said second saddle slider in a second selected direction, said second pair of clamps being fastened to said first saddle slider so that said second selected direction is substantially perpendicular to said first selected direction; and (c) wherein said framing member is fastened to said second saddle slider so as to permit bi-lateral movement of said assembled framing member and said building panel relative to said supporting substrate.

* * * * *

UNITED STATES PATENT AND TRADEMARK OFFICE

CERTIFICATE OF CORRECTION

PATENT NO. : 5,743,063
DATED : April 28, 1998
INVENTOR(S) : David W. Boozer

It is certified that error appears in the above-identified patent and that said Letters Patent is hereby corrected as shown below:

Column 11, line 13, after "80" insert --(see Figure 8)--.

Column 11, line 34, delete "point A, at".

Column 11, line 35, delete the comma (,).

Column 11, line 53, after "160" insert --see Figure 15--.

Column 11, line 60, after "due" insert --to--.

Column 11, line 63, after "member" insert --of--.

Signed and Sealed this

Sixth Day of October, 1998

*Attest:*

Bruce Lehman

BRUCE LEHMAN

*Attesting Officer*

*Commissioner of Patents and Trademarks*